US006585043B1

(12) United States Patent
Murray

(10) Patent No.: US 6,585,043 B1
(45) Date of Patent: Jul. 1, 2003

(54) FRICTION REDUCING TOOL

(75) Inventor: Geoffrey Neil Murray, Willis, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/554,180

(22) PCT Filed: Nov. 3, 1998

(86) PCT No.: PCT/NZ98/00158

§ 371 (c)(1),
(2), (4) Date: Sep. 27, 2000

(87) PCT Pub. No.: WO99/24690

PCT Pub. Date: May 20, 1999

(30) Foreign Application Priority Data

Nov. 10, 1997 (NZ) ..... 329151

(51) Int. Cl.[7] ..... E21B 17/10

(52) U.S. Cl. ..... 166/241.3; 166/241.6; 175/325.3

(58) Field of Search ..... 166/241.3, 241.6; 175/325.3

(56) References Cited

U.S. PATENT DOCUMENTS

| | | | | | |
|---|---|---|---|---|---|
| 1,801,294 | A | * | 4/1931 | Sutton | 166/241.3 |
| 1,890,529 | A | * | 12/1932 | Santiago | 166/241.3 |
| 1,913,365 | A | * | 6/1933 | Bailey | 175/325.3 |
| 1,923,328 | A | * | 8/1933 | Reed | 166/241.3 |
| 2,696,367 | A | | 12/1954 | Robishaw | 255/28 |
| 4,620,802 | A | * | 11/1986 | Harrel | 384/53 |
| 4,811,792 | A | | 3/1989 | Lembcke et al. | 166/381 |
| 5,033,558 | A | | 7/1991 | Russo et al. | 175/325 |
| 5,358,042 | A | * | 10/1994 | Stoltz | 166/241.6 |
| 5,560,716 | A | * | 10/1996 | Tank et al. | 384/492 |
| 5,649,603 | A | * | 7/1997 | Simpson et al. | 175/323 |
| 5,778,976 | A | * | 7/1998 | Murray | 166/241.6 |
| 6,209,667 | B1 | * | 4/2001 | Murray et al. | 175/325.3 |

FOREIGN PATENT DOCUMENTS

| | | | | |
|---|---|---|---|---|
| FR | 2542367 | * | 9/1984 | E21B/17/10 |
| RU | 2055975 | * | 3/1996 | E21B/17/10 |
| WO | WO 95/21986 | | 8/1995 | |
| WO | WO 96/34173 | | 10/1996 | |
| WO | WO 97/12116 | | 4/1997 | E21B/17/12 |
| WO | WO 98/40601 | | 9/1998 | E21B/17/10 |

OTHER PUBLICATIONS

PCT International Search Report for International Application PCT/NZ 96/00034 mailed Aug. 29, 1999.
PCT International Search Report for International Application PCT/NZ 95/00012 mailed Apr. 28, 1995.
Supplementary European Search Report, Application No. EP 98 95 1834, dated Sep. 6, 2002.
PCT/NZ 98/00158 International Search Report dated Mar. 5, 1999.*

* cited by examiner

*Primary Examiner*—Hoang Dang
(74) *Attorney, Agent, or Firm*—Moser, Patterson & Sheridan, L.L.P.

(57) ABSTRACT

A centralizer having a first group of rollers (5) for reducing friction between the centralizer and an oil field tubular (7) and a second group of rollers (4) for reducing friction between the centralizer and the wall of a well. The axles of the first group of rollers (5) are generally aligned with the axis of the bore (2) to reduce rotational friction. The axles of the rollers of the second group of rollers (4) are generally transversed to the bore (2). The arrangement reduces rotational and axial drag between an oil field tubular (7) and the walls of a well, particularly when initiating rotation of an oil field tubular.

39 Claims, 5 Drawing Sheets

FRICTION REDUCING TOOL

THE TECHNICAL FIELD

The present invention relates to a centraliser for use in drilling applications. More particularly, the present invention relates to a centraliser having externally projecting rollers to minimise axial drag and internally projecting rollers to minimise rotational drag between the centraliser and an oil field tubular such as a casing, liner or drill string.

BACKGROUND OF THE INVENTION

During the drilling of a well, centralisers may be employed to maintain the required alignment of the drill string. After a well has been drilled centralisers may be employed to centrally locate a liner or casing within the well.

When cementing a liner within a well it is desirable that the liner is able to rotate to ensure optimum cement distribution. To date centralisers have typically consisted of a tubular body having radially projecting fins with the liner simply located within the bore of the centraliser. Chemical lubricants have been added to drilling mud to minimise the friction between the centralisers and the liner. Chemical lubricants are effective once the liner has been rotated with respect to the centraliser. However, the initial torque required to rotate the liner may be very great and may be beyond the limit of the rig or may exceed the torque that can be borne by the liner connections.

It is also desirable to minimise the drag between a drilling string and the well bore when a centraliser is employed to reduce the torque required by the rig and minimise stress on components of the rig.

DISCLOSURE OF THE INVENTION

It is therefore an object of the present invention to provide a centraliser that reduces friction between the centraliser and drilling string, casing or liner or at least provide the public with a useful choice.

There is thus provided a centraliser comprising:

a generally tubular body;

a first group of rollers rotatably secured to the body at intervals about the body and positioned to project into the bore of the body to reduce rotational drag between the centraliser and an oil field tubular; and a second group of rollers rotatably secured about the outer periphery of the body which project beyond the outer periphery of the body to reduce axial drag between the centraliser and the walls of a well.

The oil field tubular may be a drill string, liner or casing. The body of the centraliser may be of one part or two part construction.

The rollers are preferably cylindrical rollers tapered at their ends. The axles of the second group of rollers are preferably substantially parallel with the axis of the bore in the body. The axles of the first group of rollers are preferably substantially transverse to the axis of the bore of the body. The rollers are preferably designed so that should an axle break the roller will be contained within the centraliser body.

BRIEF DESCRIPTION OF THE DRAWINGS

The invention will now be described by way of example with reference to the accompanying drawings in which.

BEST MODE FOR CARRYING OUT THE INVENTION

Figure 1:
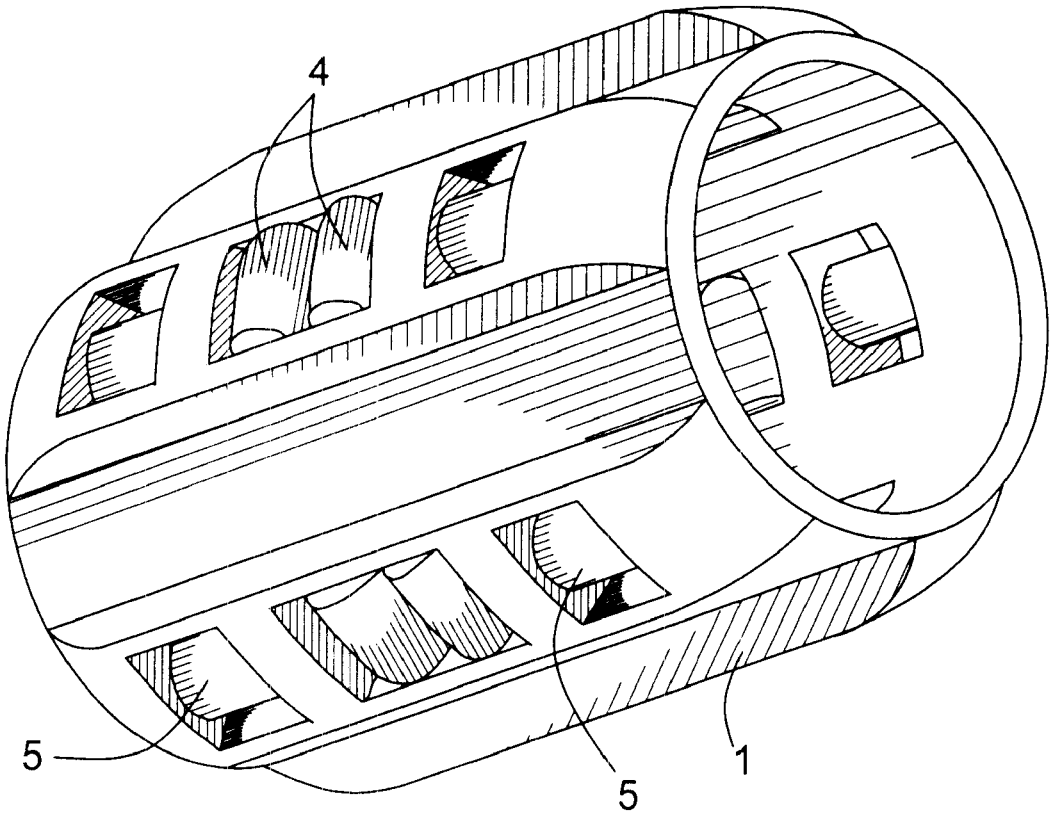
FIG. 1: is a perspective view of a centraliser according to the Invention.
Figure 2:
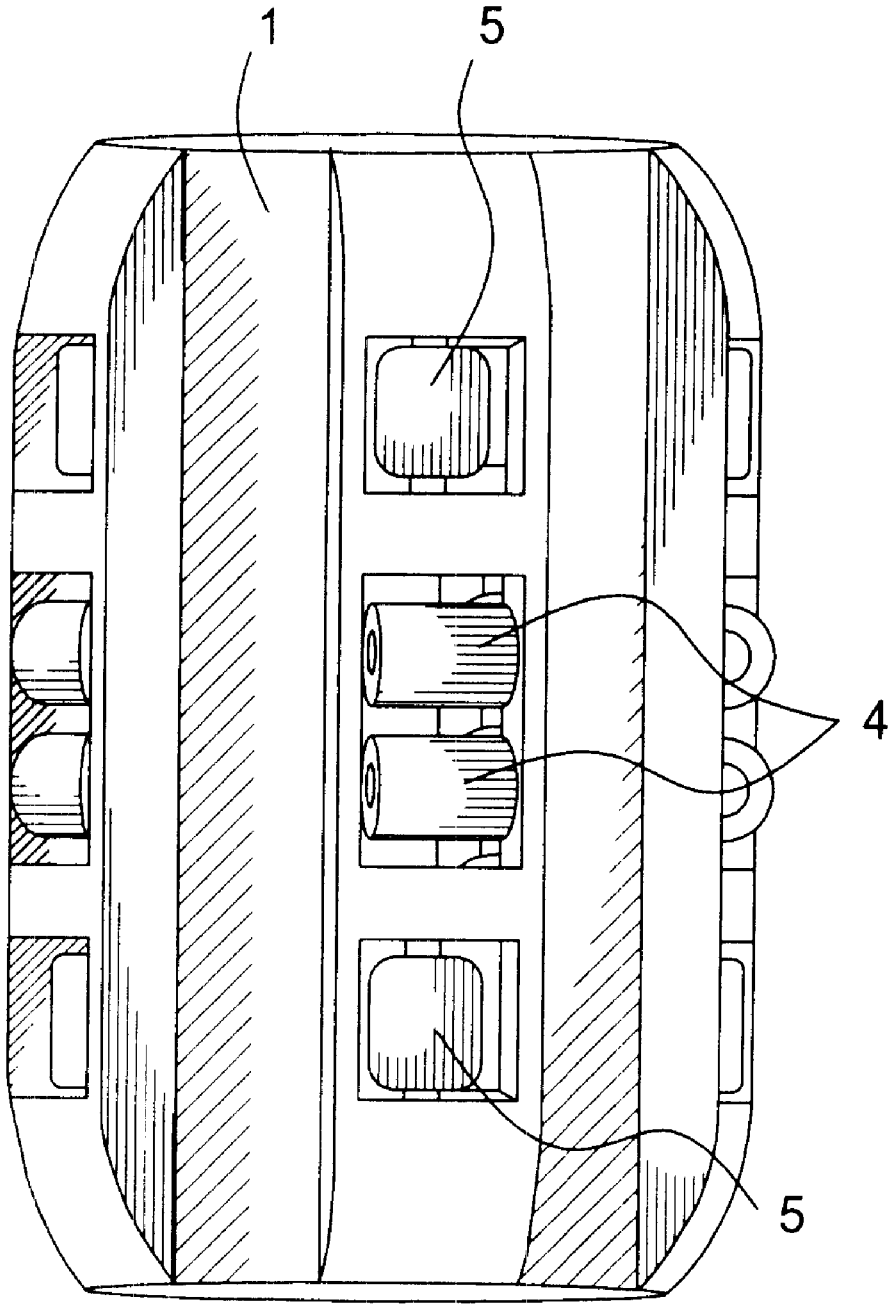
FIG. 2: is a side view of the centraliser shown in FIG. 1.
Figure 3:
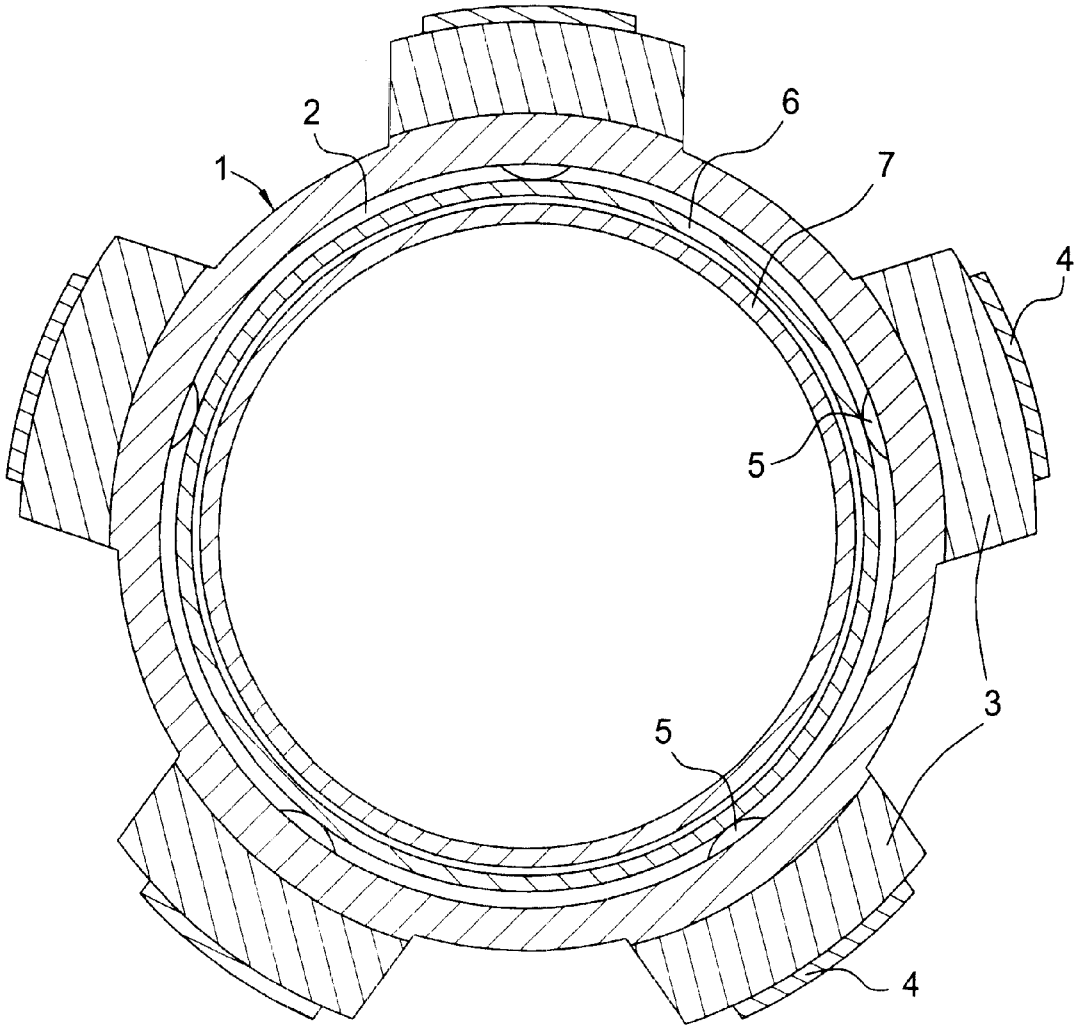
FIG. 3: is a top view of the centraliser shown in FIGS. 1 and 2 when fitted to a liner.

Referring to FIGS. 1 to 3 there is shown a centraliser having a generally tubular body 1 having a bore 2 there through and pedestals 3 about the periphery thereof. Rollers 4 are provided having their axles substantially transverse to the axis of bore 2 and projecting outwardly beyond pedestals 3. Rollers 4 are positioned to reduce axial drag between the centraliser and the walls of a well.

Rollers 4 are preferably of a generally cylindrical form tapering at each end to better conform to the shape of the wall of a well.

The axles of rollers 5 are substantially parallel to the axis of bore 2 and project into bore 2. Rollers 5 are positioned to engage the exterior surface of an oil field tubular such as a drill string, liner or casing. In the example shown in FIG. 3 rollers 5 engage a sleeve 6 provided on liner 7. Sleeve 6 may be formed of plastic or metal, although metal is preferred, to further assist in drag reduction.

Figure 5:
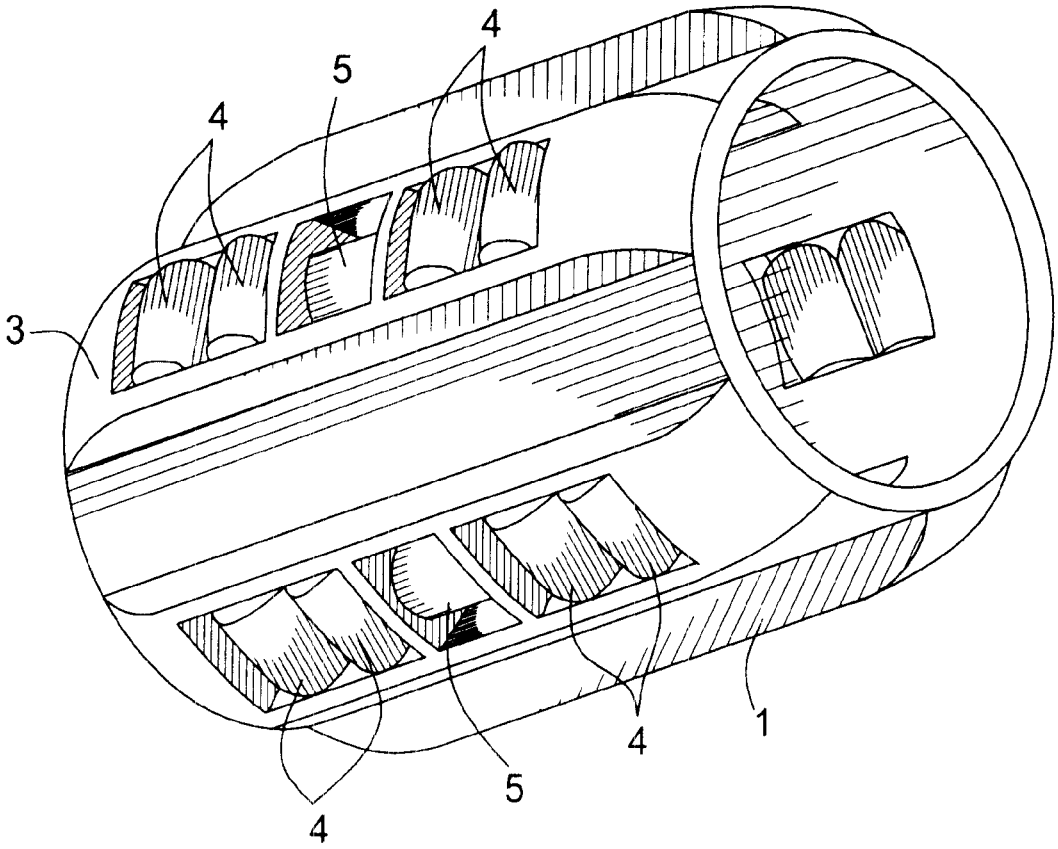
FIG. 5 is a perspective view of a centraliser according to the invention.

With reference now to FIG. 5, it will be appreciated that the rollers may be provided in different locations. For example, the positions of rollers 4 and 5 may be interchanged so that rollers 4 are provided within the regions at the top and bottom and rollers 5 are centrally located. It is preferred that banks of two or more rollers 4 and 5 be provided for each orientation on each pedestal so as to better distribute load and maintain correct orientation.

Body 1 may be of one or two part construction; two part construction being appropriate where a centraliser must be fitted to an assembled drilling string or liner or casing. Body 1 is preferably formed of metal or plastic. Rollers 4 and 5 are preferably formed of metal, ceramics, plastics or rubbers. Three or more pedestals are preferably provided about body 1, although 5 pedestals are preferred.

Figure 4:
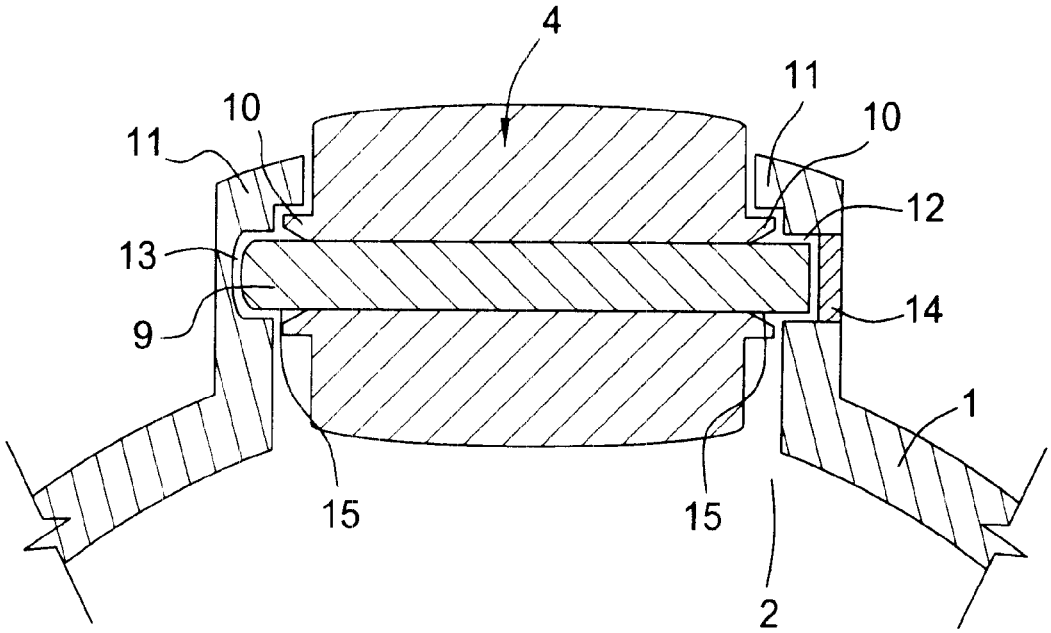
FIG. 4: shows the roller containment construction.

Referring now to FIG. 4 the roller containment design is shown in relation to a roller 4. Axle 9 secures roller 4 to body 1. Roller 4 has projections 10 adjacent overhangs 11. In assembly, roller 4 is inserted from within the centraliser from bore 2 into the position shown in FIG. 4. Axle 9 is then inserted through bore 12 and located within bore 13 in the position shown in FIG. 4. Axle 9 is then fixed in place by welding 14 or other suitable securing means. Projections 10 include recessed portions 15 so as not to place undue sheer force on axle 9 at the ends of roller 4. Should axle 9 fail, roller 4 will be contained by overhangs 11 within the centraliser. Rollers 5 are of a similar construction. This avoids broken components causing an obstruction.

Axle 9 is preferably formed of steel and may be hardened by nitriding, case hardening or plating with electroless nickel/phosphorous/PTFE or other platings.

Where such a centraliser is used in conjunction with the drilling string the rollers must be able to withstand high wear. In this case the interior bore of the rollers adjacent to the axle and exterior surface of the rollers are preferably coated with polycrystalline diamond compact (PDC). This is a synthetic diamond material that provides an extremely hard surface that withstands high wear.

The centraliser may simply be placed on a section of drilling string, casing or liner or stock collars may be provided at either end to keep the centraliser at a fixed position.

The invention therefore provides a centraliser that is effective to reduce axial and rotational drag, particularly rotational drag between an oil field tubular and the centraliser.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope of the invention as defined in the appended claims.

What is claimed is:

1. A centraliser comprising:

a generally tubular body comprising an overhang;

a first group of rollers rotatably secured to the body at intervals about the body and positioned to project within a bore of the body to reduce rotational drag between the body and a first tubular disposed there through;

a second group of rollers rotatably secured about an outer periphery of the body which projects beyond the outer periphery of the body to reduce axial drag between the body and a second tubular disposed there around; and wherein the rollers further comprise a projection at each end adjacent the overhang and the rollers and body are dimensioned so that should an axle associated with a roller fail, the roller remains contained within the body.

2. The centraliser as claimed in claim 1 wherein axles of the rollers of the first group of rollers are substantially parallel with a longitudinal axis of the bore.

3. The centraliser as claimed in claim 1 wherein axles of the rollers of the second group of rollers are generally transverse to a longitudinal axis of the bore.

4. The centraliser as claimed in claim 1 wherein the first group of rollers are provided in banks of two or more rollers at spaced intervals about the body.

5. The centraliser as claimed in claim 1 wherein the second group of rollers are provided in banks of two or more rollers at intervals about the body.

6. The centraliser as claimed in claim 1 wherein the rollers are located within one or more pedestals provided at spaced intervals about the body.

7. The centraliser as claimed in claim 6 wherein three or more pedestals are provided about the outer periphery of the body at spaced intervals.

8. The centraliser as claimed in claim 1 wherein the rollers are housed within cavities in the body.

9. The centraliser as claimed in claim 1 wherein the rollers of the first group of rollers are located within a central region of the centraliser and the rollers of the second group of rollers are located within regions at either end of the body.

10. The centraliser as claimed in claim 1 wherein rollers of the second group of rollers are located within a central region of the body and rollers of the first group of rollers are located within regions at either end of the body.

11. The centraliser as claimed in claim 1 wherein at least some rollers have internal bores for receiving axles that are coated with a polycrystalline diamond compact.

12. The centraliser as claimed in claim 1 wherein the exterior surfaces of at least some rollers are coated with a polycrystalline diamond compact.

13. The centraliser as claimed in claim 1 wherein at least some of the rollers are of generally cylindrical form and taper at each end.

14. The centraliser as claimed in claim 1 wherein the body is of one part construction.

15. The centraliser as claimed in claim 1 wherein the body is of two part construction.

16. A friction reduction tool, comprising:

an annular body having a longitudinal bore disposed there through; and at least one roller assembly, comprising:

one or more recesses disposed about the body; and one or more rollers each disposed about an axle, wherein the axle is connectable within the one or more recesses so that should the axle fail, the roller remains contained within the body, wherein each of the one or more rollers has a projection at each end and a recessed portion between said projection and said axle.

17. The tool of claim 16, wherein the at least one roller assembly comprises a first roller assembly and a second roller assembly.

18. The tool of claim 17, wherein the one or more rollers of the first roller assembly are each positioned to project within the bore.

19. The tool of claim 17, wherein the one or more rollers of the second roller assembly are each positioned to project beyond an outer periphery of the body.

20. The tool of claim 17, wherein the first roller assembly is disposed at both a first and second end of the body.

21. The tool of claim 20, wherein the second roller assembly is disposed between the first roller assembly.

22. The tool of claim 21, wherein the one or more rollers of the first roller assembly are each disposed substantially parallel to a longitudinal axis of the bore.

23. The tool of claim 22, wherein the one or more rollers of the second roller assembly are each disposed substantially transverse to the longitudinal axis of the bore.

24. The tool of claim 17, wherein the second roller assembly is disposed at both the first and second end of the body, and the first roller assembly is disposed between the second roller assembly.

25. The tool of claim 24, wherein the one or more rollers of the first roller assembly are each disposed substantially transverse to the longitudinal axis of the bore, and wherein the one or more rollers of the second roller assembly are each disposed substantially parallel to the longitudinal axis of the bore.

26. The tool of claim 16, further comprising a projection disposed within each recess to prevent the axle or roller from traversing an outer diameter of the body.

27. The tool of claim 16, wherein a first tubular is disposable within the bore.

28. The tool of claim 27, wherein the body is disposable within a second tubular.

29. The tool of claim 28, wherein the tool reduces friction between an outer surface of the first tubular and an inner surface of the second tubular.

30. The tool of claim 29, wherein the first and second tubulars are selected from a group consisting of casing, liner, and work string.

31. A friction reduction tool, comprising:

an annular body having a longitudinal bore disposed there-through, a pedestal and an overhang on the pedestal; and at least one roller assembly, comprising:

one or more recesses disposed about the body in the pedestal;

one or more rollers having a projection on each end and each connectable within the one or more recesses;

means for retaining the one or more rollers within the body; and wherein the roller projection is adjacent the pedestal overhang.

32. The tool of claim 31, wherein the at least one roller assembly comprises:

at least one first roller assembly having the one or more rollers each positioned to project within the bore; and at least one second roller assembly having the one or more rollers each positioned to project beyond an outer diameter of the body.

33. The tool of claim 32, wherein the one or more rollers of the first roller assembly are each disposed substantially parallel to a longitudinal axis of the bore.

34. The tool of claim 33, wherein the one or more rollers of the second roller assembly are each disposed substantially transverse to a longitudinal axis of the bore.

35. A friction reduction tool, comprising:

an annular body having a longitudinal bore disposed there-through; and at least one roller assembly, comprising:

one or more recesses disposed about the body;

one or more rollers each disposed about an axle;

one or more projections each disposed within the one or more recesses to retain the one or more rollers within the body;

a first roller assembly having the one or more rollers each positioned to project within the bore; and a second roller assembly having the one or more rollers each positioned to project beyond an outer diameter of the body.

36. The tool of claim 35, wherein the one or more rollers of the first roller assembly are each disposed substantially parallel to a longitudinal axis of the bore.

37. The tool of claim 36, wherein the one or more rollers of the second roller assembly are each disposed substantially transverse to a longitudinal axis of the bore.

38. The tool of claim 37, wherein the first roller assembly is disposed at both a first and second end of the body, and the second roller assembly is disposed between the first roller assemblies.

39. The tool of claim 37, wherein the second roller assembly is disposed at both a first and second end of the body, and the first roller assembly is disposed between the second roller assemblies.

* * * * *